US005927729A

United States Patent [19]

Di Filippo et al.

[11] Patent Number: 5,927,729

[45] Date of Patent: Jul. 27, 1999

[54] SHOE PARTICULARLY FOR SKATING

[75] Inventors: Mario Di Filippo, Casella D'Asolo; Peter Edauw, Camalo' Di Povegliano, both of Italy

[73] Assignee: Toifin S.p.A., Italy

[21] Appl. No.: 08/746,772

[22] Filed: Nov. 15, 1996

[30] Foreign Application Priority Data

Apr. 4, 1996 [IT] Italy ..... TV96A0046

[51] Int. Cl.[6] ..... A63C 1/04; A63C 17/00

[52] U.S. Cl. ..... 280/11.3; 280/7.13; 280/11.22; 36/118.9

[58] Field of Search ..... 280/7.13, 7.14, 280/11.22, 11.23, 11.3, 11.31, 11.33, 613; 36/117.3, 117.4, 118.2, 118.3, 118.4, 118.8, 118.9

[56] References Cited

U.S. PATENT DOCUMENTS

| | | | |
|---|---|---|---|
| 34,590 | 3/1862 | Plimpton | 280/11.3 |
| 46,497 | 2/1865 | Race | 280/11.3 |
| 2,244,719 | 6/1941 | Mansfield | 180/11.3 |
| 2,498,085 | 2/1950 | Lehmkuhl | 36/117.3 |
| 3,292,940 | 12/1966 | Weitzner | 280/7.13 |
| 3,526,976 | 9/1970 | Jacobs . | |
| 4,008,901 | 2/1977 | Conn | 280/7.13 |
| 4,021,056 | 5/1977 | Oakes | 280/6.13 |
| 4,078,322 | 3/1978 | Dalebout | 36/117.4 |
| 4,141,295 | 2/1979 | Schaefer . | |
| 4,150,499 | 4/1979 | Wang . | |
| 4,601,118 | 7/1986 | Zanatta | 36/118.2 |
| 5,193,827 | 3/1993 | Olson | 280/11.22 |
| 5,393,077 | 2/1995 | Wanous | 280/11.2 |
| 5,411,278 | 5/1995 | Wittmann | 280/11.22 |
| 5,452,907 | 9/1995 | Meibock et al. | 280/11.3 |
| 5,675,917 | 10/1997 | Falguere et al. | 36/118.2 |
| 5,704,139 | 1/1998 | Okajima | 280/613 |

FOREIGN PATENT DOCUMENTS

| | | | |
|---|---|---|---|
| A-0551704 | 7/1993 | European Pat. Off. . | |
| A-2291715 | 6/1976 | France . | |
| 197807 | 7/1978 | Switzerland | 280/11.22 |
| A-2068739 | 8/1981 | United Kingdom . | |

*Primary Examiner*—J J Swann
*Assistant Examiner*—Frank Vanaman
*Attorney, Agent, or Firm*—Rockey, Milnamow & Katz

[57] ABSTRACT

A shoe, particularly for skating, includes a soft upper below which a sole for walking is rigidly coupled. The shoe has, at the lower surface of the sole and longitudinally thereto, a seat for a rigid plate having temporary engagement member for a grip member associated with a supporting frame for in-line wheels. A rigid cuff is associated with the upper, oscillates transversely and longitudinally with respect to the upper, and cooperates with an element for limiting and controlling the oscillation which is associated with the supporting frame for the in-line wheels. It is thus possible to use the shoe both for ordinary walking and for skating.

18 Claims, 5 Drawing Sheets

SHOE PARTICULARLY FOR SKATING

BACKGROUND OF THE INVENTION

The present invention relates to a shoe particularly for skating.

Conventional walking shoes are substantially constituted by a soft upper below which a sole is coupled.

Those conventional shoes are not adapted for a different use, such as for example the use of the same shoe for skating on adapted skates, for example of the type with in-line wheels, because such use would cause considerable problems for the non-advanced user.

For this purpose, skates are known which have a wheel supporting frame above which means for coupling to a shoe are associated. Those means are constituted by a toe unit and a heel unit, and the heel unit is provided with fastening means whereat a shoe, possibly of the type used for normal walking, is inserted.

However, this solution has considerable drawbacks, because the shoe is not perfectly associated with the frame and it is therefore possible to perform relative movements of the foot and of the leg with respect to the frame, to the detriment of the smoothness of the skating action.

Furthermore, when thrusting the skate, the shoe can slip out of the toe unit, causing the user to fall down.

Finally, it is noted that the movement of the leg during skating is not optimum, since said leg must be locked firmly to the fastening means.

In conventional in-line skates, instead, the foot is usually inserted at an adapted shell made of rigid plastics and is rigidly coupled to the underlying wheel support; an equally rigid cuff is usually articulated to said shell to contain an optional soft innerboot.

This shoe, therefore, cannot be used for walking.

This problem is felt all the more because skates with in-line wheels are currently used as a means of transport and the user has to separately carry spare shoes once he stops skating.

SUMMARY OF THE INVENTION

A principal aim of the present invention is therefore to solve the described problems, eliminating the drawbacks of the cited prior art and thus providing a shoe that can be used both together with a roller skate or an ice skate, for easy and optimum skating, and for ordinary walking, with optimum comfort for the user.

Within the scope of this aim, an important object is to provide a multipurpose shoe having optimum, albeit contrasting, structural characteristics, as a function of the specific use, such as walking and use with a frame that supports in-line wheels or an ice-skating blade.

Another object is to provide a shoe that is structurally simple and can be manufactured with conventional machines and equipment.

This aim, these objects, and others which will become apparent hereinafter are achieved by a shoe, particularly for skating, comprising a sole rigidly coupled below a soft upper, at least one seat at a lower surface of said sole and longitudinally thereto, said at least one seat accomodating at least one rigid plate having temporary engagement means for grip means that are associated with a supporting frame for in-line wheels or for a blade, a rigid cuff being associated with said upper, said cuff oscillating transversely and longitudinally with respect to said upper and cooperating with means for limiting and controlling said oscillation which are associated with said supporting frame.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
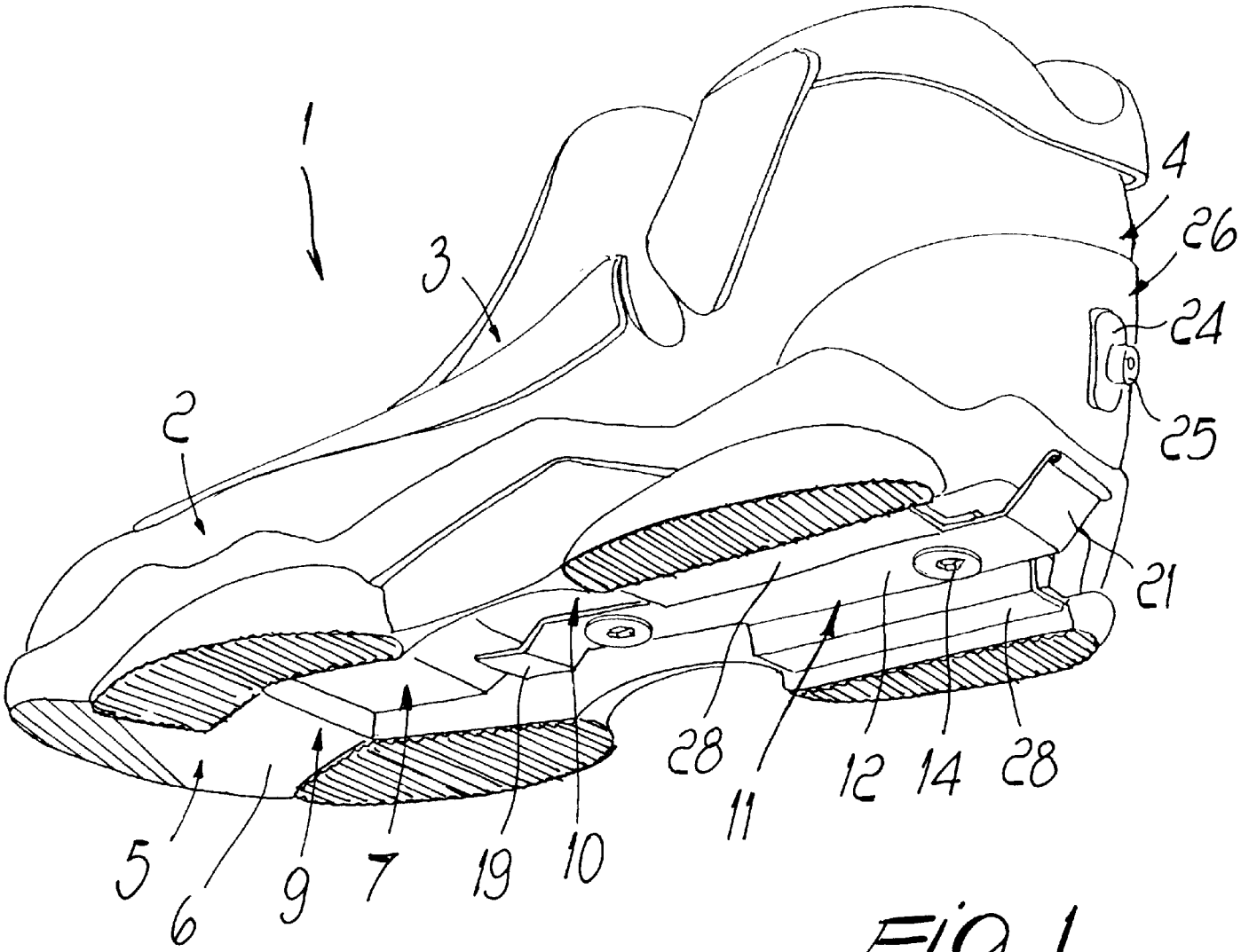
FIG. 1 is a bottom perspective view of the upper constituting the shoe.
Figure 2:
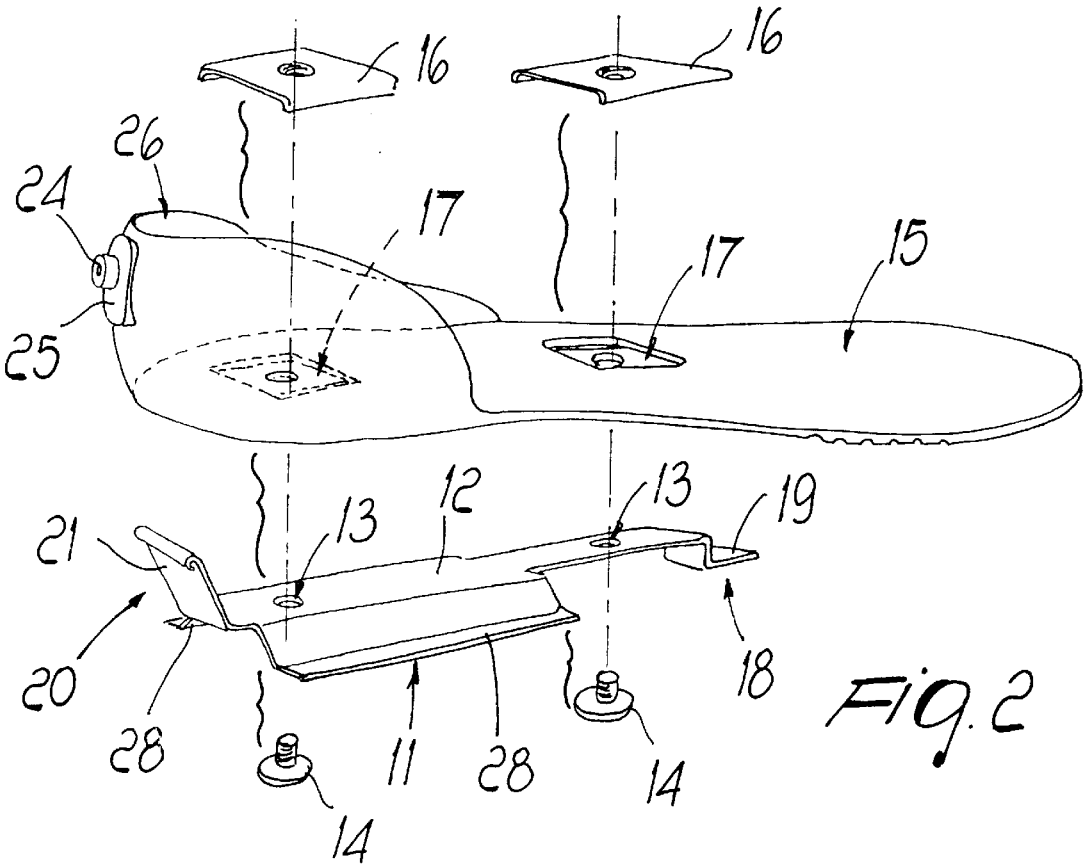
FIG. 2 is an exploded perspective view of some components of the shoe.
Figure 3:
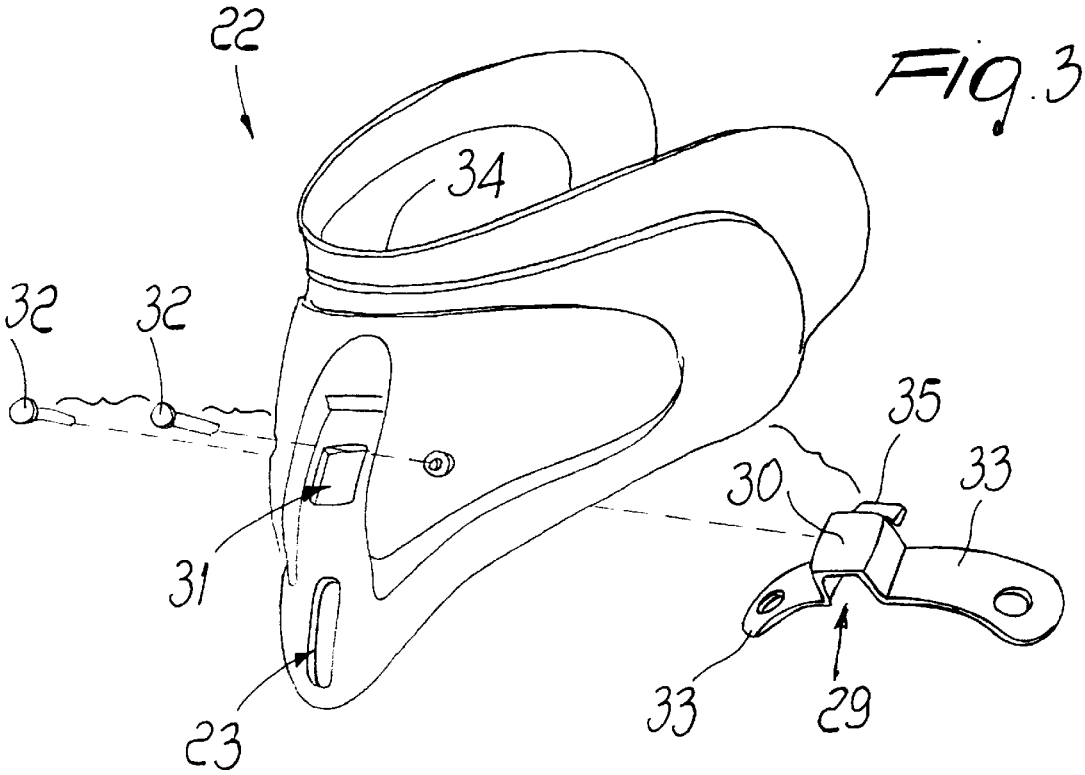
FIG. 3 is a lateral perspective view of the rigid cuff that is associable with the upper.
Figure 4:
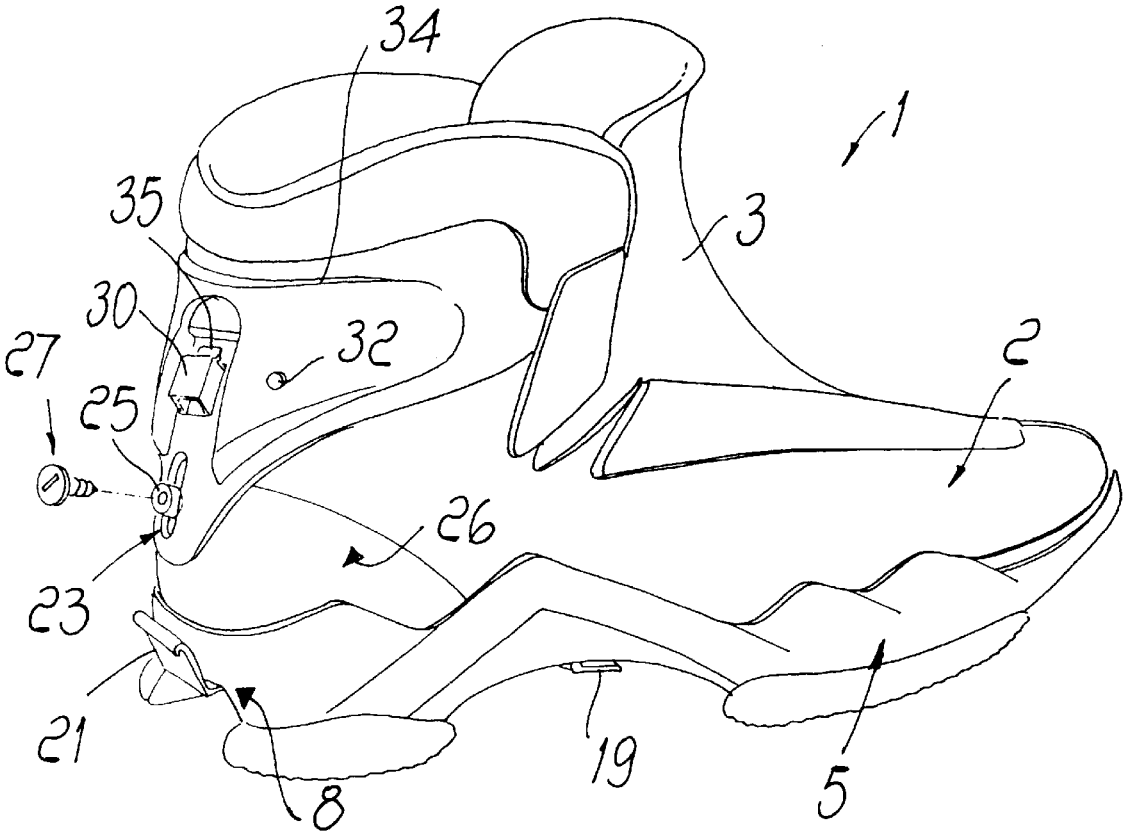
FIG. 4 is a lateral perspective view of the assembled shoe.

With reference to the above figures, the reference numeral 1 designates the shoe, which comprises an upper 2 made of soft material, having an opening, at the foot instep region. The opening forms two flaps that overlap at an adapted tongue 3 associated with the upper.

The upper has a heel unit 4, also made of soft material, that surrounds the malleolar region of the foot, and an adapted sole 5 is associated below the upper 2.

At least one seat 7 is formed at the lower surface 6 of the sole 5 and longitudinally thereto. The seat affects the sole starting from the rear end 8 thereof up to approximately the region 9 that is adjacent to the pre-arch region and behind the region of the sole of the foot that must flex during walking.

The region differentiates the shoe into a part that is essential for walking (the one directed towards the toe of the upper) and into a part that is essential for skating (the one directed towards the heel).

According to a transverse cross-section, seat 7 has a substantially omega-shaped or trapezoidal cross-section, so as to form a substantially flat resting surface for a rigid plate 11 that is connected to two inclined side walls.

The plate 11 also has a body 12 in which adapted holes are formed. The holes accommodate adapted first screws 14 for connection to adapted threaded plates 16, through the interposition of an adapted rigid or semirigid insole 15 arranged between the upper 2 and the sole 5. The complementarily threaded plates 16 can be accommodated, in a concealed manner, at adapted first seats 17 formed on said insole 15.

The surface 10 of the seat 7 and the dimensions of the plate 11 are such as to arrange the body 12 on a plane that is approximately parallel to the underlying ground resting plane of the remaining part of the sole 5.

The plate 11 has, at the end that is arranged approximately in the pre-arch part of the foot, first engagement means constituted by a first L-shaped wing 18, a first flap 19 whereof is arranged on a plane that is approximately parallel to the plane of the surface 10 towards the ground.

At the end that is adjacent to the rear end 8 of the sole 5, the plate 11 has second engagement means constituted by a second L-shaped wing 20, a second flap 21 whereof protrudes to the rear of the sole 5 and is inclined upwards.

The shoe comprises a rigid cuff 22 that is associable with the upper 2 at the heel unit 4; means for fastening the upper and the cuff are provided.

The cuff is provided with a longitudinal slot 23 in a rear region. An adapted pin 24 can be slidingly arranged in slot 23 and protrudes from a plate 25 associated in a rear region at an adapted buttress 26 that is provided at, and protrudes from, the insole 15.

Figures 5, 6, 7:
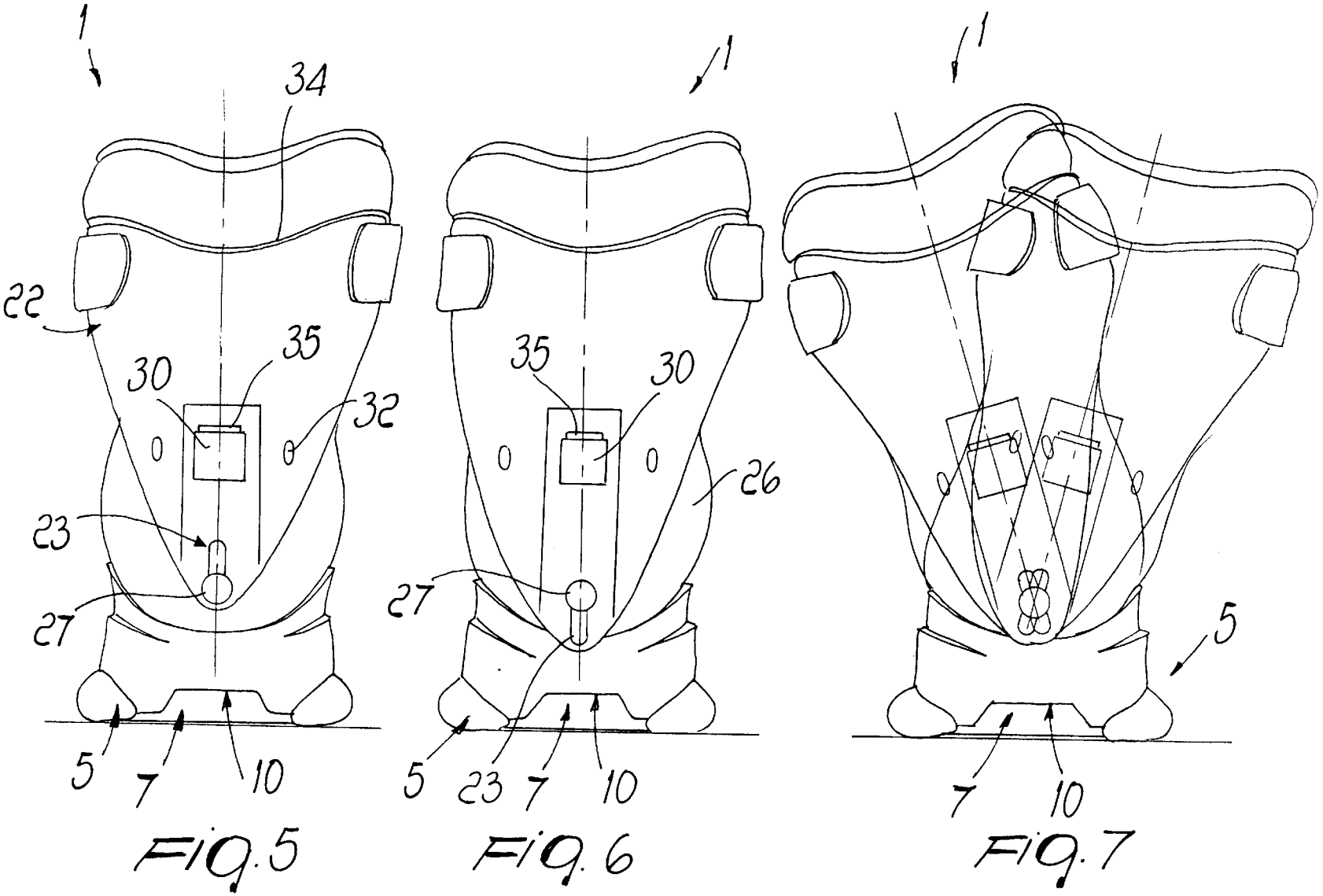
FIG. 5 is a rear view of the shoe with the cuff pivoted forwardly in a longitudinal plane of the shoe.
FIG. 6 is a rear view of the shoe with the cuff pivoted rearwardly in the longitudinal plane of the shoe.
FIG. 7 is a rear view of the shoe showing the cuff pivoting laterally in a transverse plane of the shoe.
Figure 8:
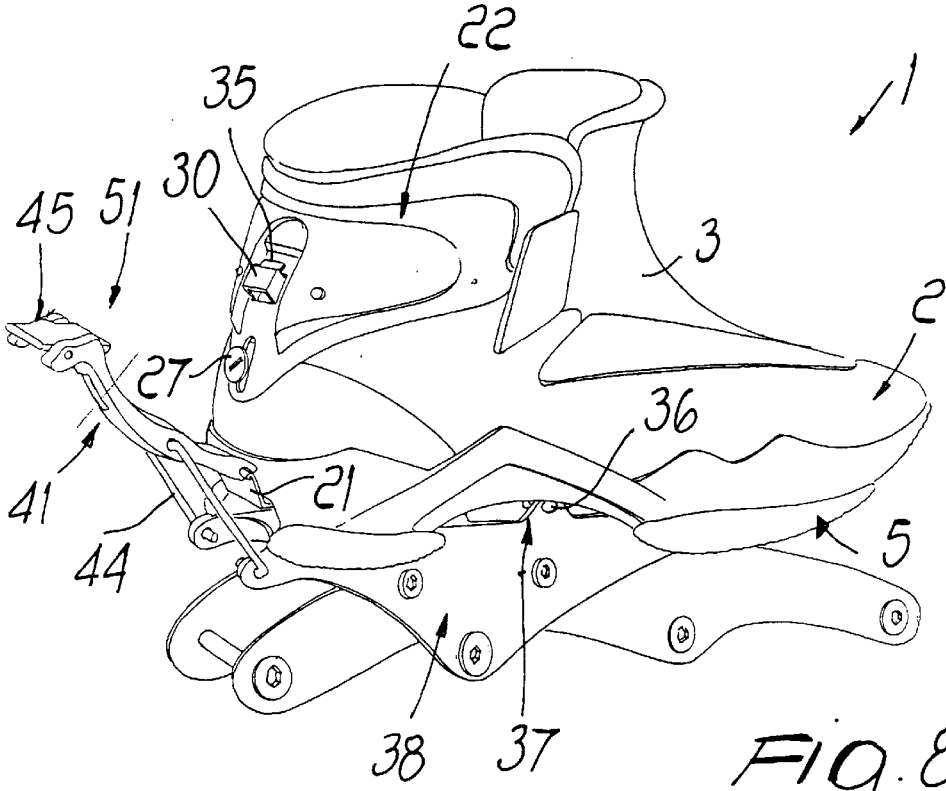
FIG. 8 is a view, similar to FIG. 4, of the shoe associated with the supporting frame for in-line wheels.
Figure 9:
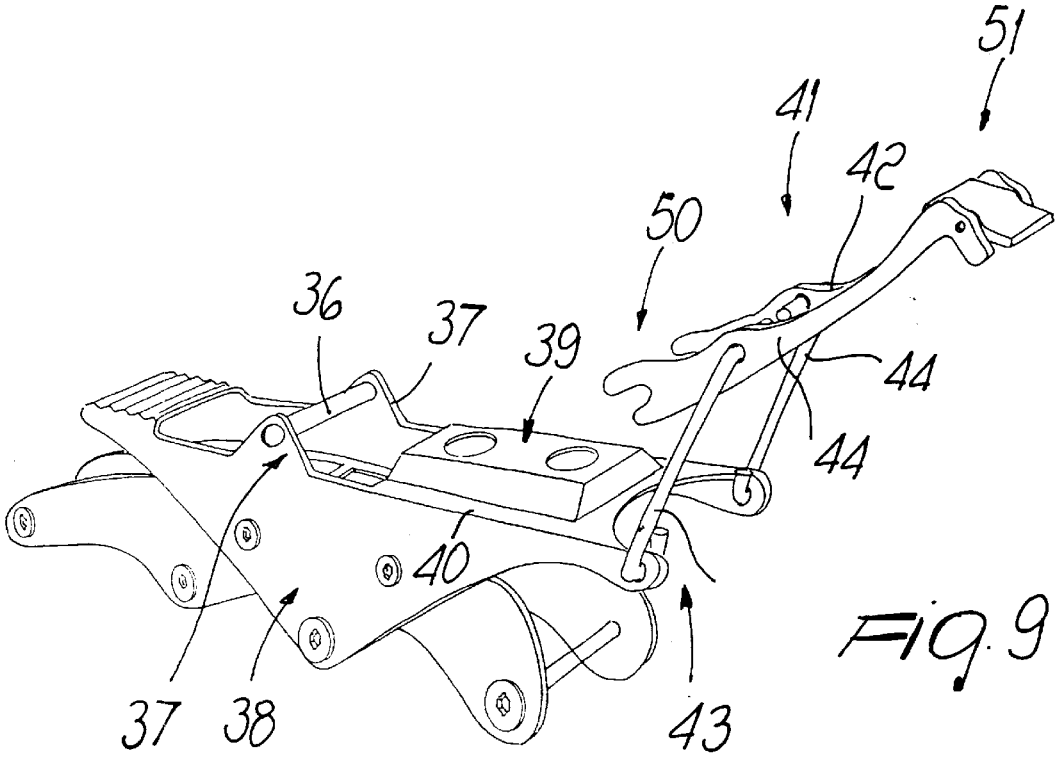
FIG. 9 is a view, similar to FIG. 8, of the supporting frame for the in-line wheels.

The connection between the cuff 22 and the buttress 26 occurs by using an adapted second screw 27. The cuff 22 is thus allowed to perform an oscillation, shown in FIGS. 5, 6, and 7, which can occur along a plane that is substantially transverse or longitudinal with respect to the sole 5 or along a combination of two planes.

The plate 11 has means for centering its position within the seat 7; the means are constituted by two third wings 28 that protrude laterally to the body 12 and are shaped approximately complementarily with respect to the shape of the seat 7.

A substantially omega-shaped profiled element 29 is associated with the cuff 22, in a region lying above the slot 23, and its central body 30 protrudes externally and to the rear of the cuff 22 through an adapted opening 31 formed in the cuff, whereas said profiled element is associated with the cuff by means of adapted rivets 32 that affect the fourth wings 33 of the profiled element.

A tooth 35 protrudes from the central body 30 of the profiled element towards the upper edge 34 of the cuff 22.

The first engagement means, constituted by the first wing 18, temporarily interact with complementarily shaped first grip means constituted by a pivot 36 that is arranged transversely to two shoulders 37 that protrude laterally and upwardly with respect to the flat base 40 of a supporting frame 38 for two or more wheels, that are preferably arranged in a line, or for an ice-skating blade.

The L-shaped configuration of the first engagement means allows to withstand any impacts to which the frame 38 might accidentally be subjected during skating, so as to allow to keep the shoe in its position and firmly coupled to the frame.

Substantially the shoe is associated with the frame 38 by inserting the pin 36 in the gap between the first flap 19 and the surface 10 of the seat 7.

In this manner, the body 12 of the plate 11 rests at an adapted and complementarily shaped raised portion 39 that protrudes upward and along the axis that runs longitudinally to the flat base 40 of the frame 38. The raised portion lies on a lower plane with respect to a plane that is parallel thereto and passes through the pin 36.

The raised portion 39 thus constitutes an additional means for centering the shoe with respect to the frame 38.

The shoe is then temporarily and stably associated with the frame 38 by second grip means, constituted by a lever arm 41 that is substantially U-shaped in cross-section, so as to form third flaps 42 which are centrally or eccentrically pivoted to the underlying end 43 of the frame by means of adapted arms 44.

A first end 50 of the third flaps 42 has a fork-like shape that is adapted to engage at the underlying end of the second flap 21: in this manner, the shoe is locked to the underlying frame 38.

A safety hook 45 is transversely pivoted, optionally in engagement with a flexible element, to the second end 51 of the third flaps 42 of the lever arm 41 that is opposite to the fork-shaped end. The hook can be temporarily engaged at the tooth 35 that protrudes from the central body 30 of the profiled element 29, and the coupling between the hook 45 and the tooth 35 allows to limit, by controlling it, the oscillation of the cuff 22, also confirming to the user that the shoe is rigidly coupled to the frame 38 and is therefore in a condition that allows skating.

The closure of the lever arm 41 also allows to limit the rear longitudinal flexing of the cuff, maintaining effectiveness in braking, as well as front longitudinal flexing, entrusting it to the deformation of the materials, and to the lateral flexing of the shoe, so as to make it more adapted for skating.

If instead the user wishes to walk normally, it is sufficient to disengage the hook 45 from the tooth 35, open the lever arm 41, and extract the shoe from the pin 36 of the frame 38.

It has thus been observed that the invention has achieved the intended aim and objects, a shoe having been provided which has excellent characteristics both for use in normal walking and for skating in optimum conditions.

The provision of the soft upper and the oscillation that can be imparted to the cuff, together with the arrangement of the plate 11 in a raised position with respect to the ground resting plane of the sole, in fact allow to walk easily, whereas once the shoe is associated with the frame and the limited and controlled oscillation of the cuff is blocked, it is possible to skate in an optimum manner.

The arrangement of the plate 11 at the seat formed on a plane that is raised with respect to the surface of the sole that interacts with the ground during walking, provides an optimal connection to the frame, regardless of the wear of the sole.

The omega-shaped or trapezoidal configuration of the plate and of the seat provides optimum transmission of the forces imparted during lateral thrusting while skating.

The shoe according to the invention is of course susceptible of numerous modifications and variations, all of which are within the scope of the same inventive concept.

Thus, for example, as an alternative to the use of the rigid plate 11 it is possible to use, below the insole 15, an omega-shaped or trapezoidal tab that is applied to, or monolithic with, the insole and is located at the seat, making it pass through an adapted opening formed in the sole.

Advantageously, the tab, and optionally the entire insole, is made of rigid plastics, for example Nylon, of variable thickness and in particular with a thickness that tapers in the pre-arch region of the foot to allow the flexing required for walking.

The materials and the dimensions that constitute the individual components of the invention may of course also be the most appropriate according to the specific requirements.

What is claimed is:

1. A shoe for walking and for skating, comprising:

a soft upper;

a sole with a longitudinal extension rigidly coupled below said soft upper;

at least one seat arranged at a low surface of said sole;

at least one rigid plate accommodated in said at least one seat;

a supporting frame for in-line wheels or for a blade;

temporary engagement means of said at least one rigid plate for interacting with grip means of said supporting frame such that said supporting frame is releasably connectable with said sole;

a rigid cuff connected with said upper such that said cuff may freely oscillate in a transverse plane extending essentially transversely with respect to said longitudinal extension of said sole and in a longitudinal plane extending essentially parallel with respect to said longitudinal extension of said sole when said supporting frame is disconnected from said sole in a walking configuration of the shoe; and said grip means of said supporting frame comprising means for limiting and controlling the oscillation of said cuff in said transverse and longitudinal planes when said supporting frame is connected with said sole in a skating configuration of the shoe.

2. The shoe according to claim 1, wherein said soft upper is provided with a heel unit for surrounding a malleolar region of user's foot, said at least one seat extending in said sole from a rear end of said sole up to approximately a region that is adjacent to a pre-arch of a user's foot.

3. The shoe according to claim 2, wherein said at least one seat is substantially omega-shaped or trapezoidal in a transverse cross-section, so as to form a substantially flat surface for engagement of said at least one rigid plate, said at least one seat having two inclined side walls that are adjacent to said flat surface.

4. The shoe according to claim 3, wherein said at least one plate has a body on which holes are provided, said holes acting as seats for first screws for connection to threaded plates with an interposition of a rigid or semirigid insole arranged between said upper and said sole, said threaded plates being accommodated in a concealed manner at first seats formed on said insole.

5. The shoe according to claim 4, wherein said at least one seat and the dimensions of said at least one plate are such as to arrange said body on a plane that is approximately parallel to an underlying ground resting plane of remaining part of said sole.

6. The shoe according to claim 4, wherein said at least one plate has first engagement means of said temnporary engagement means, said first engagement means being arranged approximately at a pre-arch region of the shoe, said first engagement means being constituted by a first L-shaped wing, a first flap of said first L-shaped wing lying on a plane that is approximately parallel to a plane in which said substantially flat surface extends.

7. The shoe according to claim 6, wherein said at least one plate has second engagement means of said temporary engagement means, said second engagement means being arranged adjacent to a rear end of said sole and said second engagement means being constituted by a second L-shaped wing, and a second flap of said second L-shaped wing protruding rearwardly of the sole and being inclined upwards.

8. The shoe according to claim 7, wherein said first L-shaped wing temporarily interacts with complementarily shaped first grip means of said grip means, said first grip means being constituted by a pin that is arranged transversely to two shoulders that protrude laterally and above a flat base of said supporting frame.

9. The shoe according to claim 8, wherein said sole is associable with said supporting frame after positioning said pin in an interspace between said first flap of said first L-shaped wing and said substantially flat surface of said at least one seat, said body of said at least one plate being forced to rest at an a complementarily shaped centering means constituted by at least one raised from said flat base of said supporting frame.

10. The shoe according to claim 9, wherein said sole is temporarily stably associable with said frame through second grip means of said grip means, said second grip means being constituted by a lever arm that is substantially U-shaped in cross-section so as to form third flaps that are pivoted to an underlying end of said supporting frame by means of arms.

11. The shoe according to claim 10, wherein a first end of said third flaps is fork-shaped and is adapted to engage at an underlying end of said second flap of said second L-shaped wing.

12. The shoe according to claim 11, wherein a safety hook is transversely pivoted to a second end of said third flaps of said lever arm, said rigid cuff being connected with said upper at a heel unit, means being provided for fastening the upper and the cuff, said cuff having a rear longitudinal slot an adapted pin being slidingly arranged in said slot, said pin protruding from a plate that is connected rearwardly at an adapted buttress protruding from an insole arranged between said upper and said sole, said cuff and said buttress being connected by a second screw for permitting said cuff to freely oscillate in said transverse and longitudinal planes in said walking configuration of the shoe, a profiled element being associated with said cuff in a region lying above said slot, said profiled element being substantially omega-shaped with a central body protruding externally and rearwardly with respect to said cuff through an adapted opening formed in said cuff, said profiled element being associated with said cuff by means of rivets that affect fourth wings of said profiled element, a tooth protruding from said central body of said profiled element towards an upper perimetric edge of said cuff, said safety hook being temporarily engagable at said tooth.

13. The shoe according to claim 4, wherein said at least one plate has means for centering the position of said at least one plate within said at least one seat, said means for centering the position of said at least one plate within said at least one seat being constituted by two third wings that protrude laterally with respect to said body and are shaped approximately complemeritarily to said at least one seat.

14. The shoe according to claim 1, wherein said rigid cuff is connected with said upper at a heel unit, means being provided for fastening the upper and the cuff.

15. The shoe according to claim 14, wherein said cuff has a rear longitudinal slot, an adapted pin being slidingly arranged in said slot, said pin protruding from a plate that is connected rearwardly at an adapted buttress protruding from an insole arranged between said upper and said sole.

16. The shoe according to claim 15, wherein said cuff and said buttress are connected by a second screw for permitting said cuff to freely oscillate in said transverse and longitudinal planes in said walking configuration of the shoe.

17. The shoe according to claim 16, wherein a profiled element is associated with said cuff in a region lying above said slot, said profiled element being substantially omega-shaped with a central body protruding externally and rearwardly with respect to said cuff through an adapted opening formed in said cuff, said profiled element being associated with said cuff by means of rivets that affect fourth wings of said profiled element.

18. The shoe according to claim 17, wherein a tooth protrudes from said central body of said profiled element towards an upper perimetric edge of said cuff.

* * * * *